US006413690B2

(12) United States Patent
Tomita

(10) Patent No.: US 6,413,690 B2
(45) Date of Patent: Jul. 2, 2002

(54) TONER AND DEVELOPER FOR ELECTROPHOTOGRAPHY

(75) Inventor: Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/773,916

(22) Filed: Feb. 2, 2001

(30) Foreign Application Priority Data

Feb. 3, 2000 (JP) ..... 2000-026723
Feb. 8, 2000 (JP) ..... 2000-030313

(51) Int. Cl.[7] ..... G03G 9/097

(52) U.S. Cl. ..... 430/108.1; 430/108.4; 430/108.8; 399/222

(58) Field of Search ..... 430/108.1, 108.4, 430/108.8; 399/222

(56) References Cited

U.S. PATENT DOCUMENTS 3,556,998 A 1/1971 Steiner ..... 252/62.1
6,017,386 A * 1/2000 Sano et al. ..... 106/31.32
6,203,603 B1 * 3/2001 Takayama et al. ..... 106/31.16

FOREIGN PATENT DOCUMENTS

DE 26 44850 4/1977

* cited by examiner

*Primary Examiner*—John Goodrow
(74) *Attorney, Agent, or Firm*—Oblon, Spivak, McClelland, Maier & Neustadt, P.C.

(57) ABSTRACT

A toner contains a coloring agent and a binder including a wax and an ethyl polysaccharide, which has D-glucose units linked together by a linkage of 1,2-, 1,3-, 1,4-, or 1,6-glycosidic bond with an α configuration, or by a linkage of 1,2-, 1,3-, 1,4- or 1,6-glycosidic bond with a β configuration, with at least one alcohol hydroxyl group in each D-glucose unit being ethyl-etherified. A one-component developer for electrophotography is prepared using the toner, and a two-component developer is prepared by the combination of the toner and a carrier.

31 Claims, 1 Drawing Sheet

FIGURE
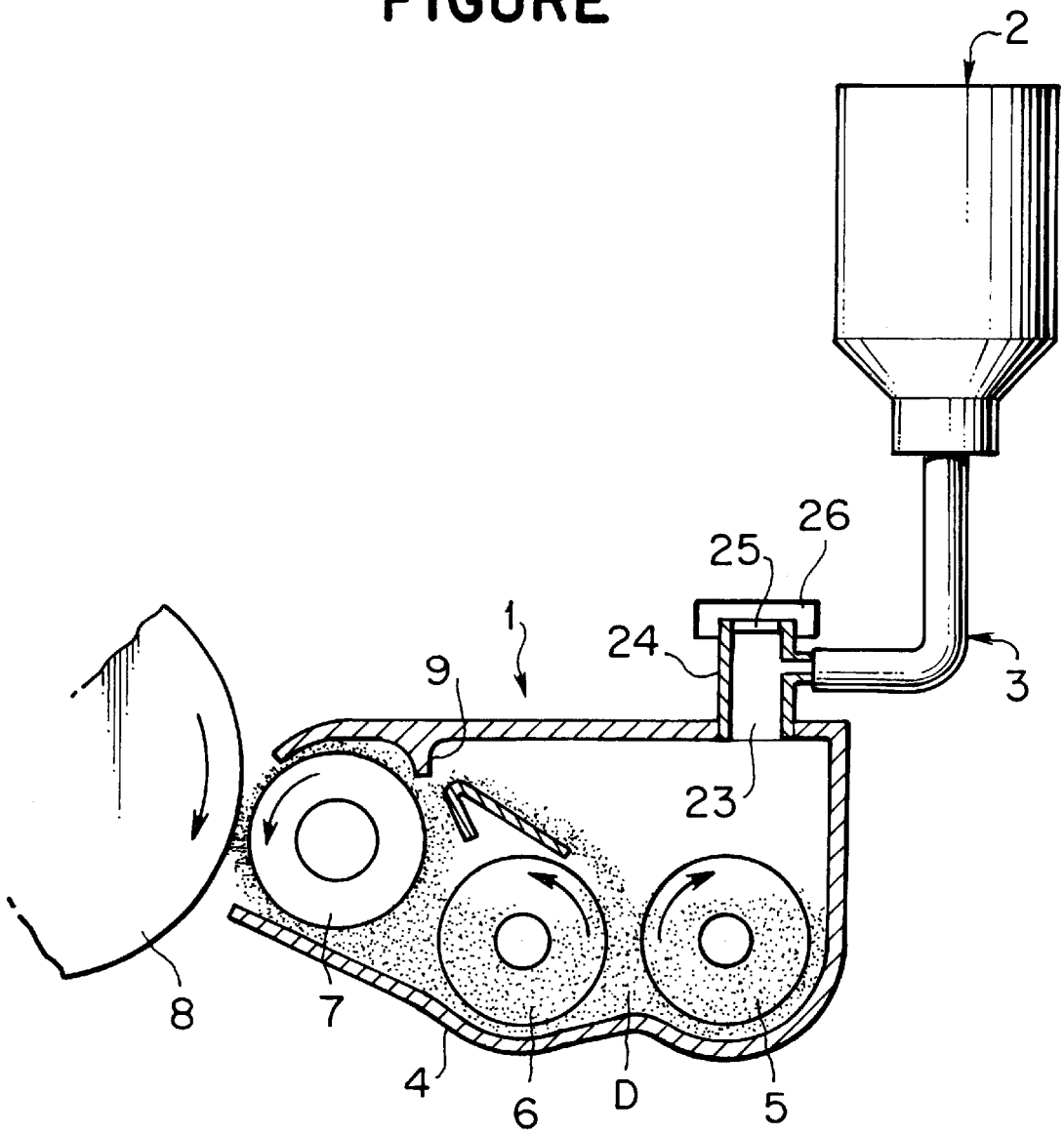

TONER AND DEVELOPER FOR ELECTROPHOTOGRAPHY

BACKGROUND OF THE INVENTION

1. Field of the Invention

The present invention relates to a toner and a developer for use in an electrophotographic copying machine, facsimile machine, and printer.

2. Discussion of Background

Conventionally, fixing of a toner image is usually achieved by the application of heat.

According to the principle of toner image fixing by means of heat application, a toner is softened or melted when heat is applied to the toner in an image fixing unit. The toner can be fixed to paper in such a way that the softened or melted toner is embedded in fibers of paper because pressure is also applied to the toner in the image fixing unit. Or, the surface of the softened or melted toner tends to become sticky by the application of heat, so that the toner can be fixed to the paper.

In light of the toner fixing mechanism mentioned above, the melting point or softening point of a resin for use in a toner composition is required to be equal to or lower than the image fixing temperature.

In recent years, there is an increasing demand for energy saving from the viewpoint of environmental protection. The energy which may be used in the image fixing unit is now being restricted. In order to decrease the energy for image fixing, there is no choice in fact but to lower the image fixing temperature that is set in the image fixing unit. Consequently, a resin with a low melting point is necessarily employed for the toner composition to cope with the image fixing unit of which the image fixing temperature is lowered. However, the resin with a low melting point tends to readily soften, so that toner particles containing the above-mentioned resin often causes caking during storage. Further, because toner particles containing such a low-melting point resin are provided with adhesive properties, interaction between the toner composition and an external additive deposited on the toner particles tends to change with time. As a result, the physical properties of the obtained toner are changed and the preservation stability of the toner is impaired.

In a developer unit, there occurs a so-called spent toner phenomenon, namely, a softened or melted toner is deposited on the surface of a carrier. Further, the toner tends to adhere to the surface of a development roller to produce a toner filming phenomenon, and the toner is easily deposited on a doctor blade in the developer unit.

Furthermore, after completion of image fixing, image-bearing sheets unfavorably stick to each other, which is referred to as a blocking phenomenon, depending on the environmental conditions.

In addition to the above, there also occurs a problem in the course of preparation of toner particles. When the conventional low-melting point resin is contained in a toner composition, it is difficult to satisfactorily pulverize the toner composition and the toner composition is apt to stick to the inner wall of a pulverizer in the pulverizing step because of excessively soft resin contained in the toner composition.

SUMMARY OF THE INVENTION

Accordingly, it is therefore a first object of the present invention to provide a toner capable of coping with a lower image fixing temperature than the conventional image fixing temperature to achieve energy-saving, exhibiting excellent preservation stability, producing no change with time in the interaction between the toner and an external additive, and causing no problems of the spent toner phenomenon and toner filming phenomenon. Further, the first object is to provide toner particles which can be obtained by efficiently pulverizing a toner composition and a toner capable of producing toner images with preservation stability after the toner is fixed to an image receiving member.

The first object of the present invention can be achieved by a toner for electrophotography comprising a coloring agent and a binder which comprises a wax and an ethyl polysaccharide.

It is preferable that ethyl polysaccharide comprise D-glucose units linked together by a linkage of 1,2-, 1,3-, 1,4-, or 1,6-glycosidic bond with an $\alpha$ configuration, or by a linkage of 1,2-, 1,3-, 1,4- or 1,6-glycosidic bond with a $\beta$ configuration, with at least one alcohol hydroxyl group in each of the D-glucose units being ethyl-etherified.

The above-mentioned toner may be fixable at a temperature lower than a melting point of the ethyl polysaccharide and higher than or equal to a melting point of the wax.

A second object of the present invention is to provide a developer for electrophotography.

The second object of the present invention can be achieved by a one-component developer for electrophotography comprising a toner which comprises a coloring agent and a binder comprising a wax and an ethyl polysaccharide. Alternatively, the second object of the present invention can be achieved by a two-component developer comprising a carrier and the above-mentioned toner.

A third object of the present invention is to provide a developer container for storing a developer therein.

The third object of the present invention can be achieved by a developer container containing the above-mentioned one- or two-component developer for electrophotography.

A fourth object of the present invention is to provide an image forming apparatus.

The fourth object can be achieved by an image forming apparatus comprising a developer unit which comprises developer storage means for storing a developer therein and developer supply means for supplying the developer to a latent-image bearing surface, wherein the developer may be a one-component developer comprising a toner comprising a coloring agent and a binder which comprises a wax and an ethyl polysaccharide, or a two-component developer comprising the above-mentioned toner and a carrier.

A fifth object of the present invention is to provide a process unit with a developer unit.

The fifth object can be achieved by a process unit comprising a developer unit which comprises developer storage means for storing a developer therein and developer supply means for supplying the developer to a latent-image bearing surface, wherein the developer may be the above-mentioned one-component developer or two-component developer.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a schematic view which shows one embodiment of an image forming apparatus provided with a developer container according to the present invention.

DESCRIPTION OF THE PREFERRED EMBODIMENTS

A binder agent for use in a toner of the present invention comprises a wax and an ethyl polysaccharide. The above-mentioned ethyl polysaccharide has a high melting point, high preservation stability, and high resistance to the spent toner phenomenon and the toner filming phenomenon.

Further, according to the present invention, a toner comprises a binder comprising an ethyl polysaccharide and a wax. By the application of heat to the toner of the present invention in the image fixing step, the ethyl polysaccharide is dissolved in the wax at a temperature higher than the melting point of the wax. Even though the image fixing temperature does not attain to the melting point of the ethyl polysaccharide, the ethyl polysaccharide is softened or dissolved in the wax, whereby the fixing properties are exhibited. In this case, the melting point of ethyl polysaccharide is so high that the binder resin mainly comprising ethyl polysaccharide does not become too flexible. The result is that the toner composition comprising such a binder resin can be efficiently pulverized to have desired toner particles.

As mentioned above, the wax and the ethyl polysaccharide are homogeneously compatible with each other in the toner composition of the present invention. In other words, the wax and the ethyl polysaccharide are homogeneously compatible to such a degree that ethyl polysaccharide can be dissolved in the wax at a temperature higher than or equal to the melting point of the wax in the image fixing step. Even though the image fixing temperature does not attain to the melting point of the ethyl polysaccharide, the ethyl polysaccharide is softened or dissolved in the wax so as to exhibit the fixing properties.

With respect to the composition ratio of the ethyl polysaccharide to the wax, the more the amount ratio of wax, the lower the viscosity of the resulting wax solution of ethyl polysaccharide. With the decrease in amount ratio of the ethyl polysaccharide, other resins than ethyl polysaccharide, if contained in the toner composition, cannot be dissolved in the wax, so that the wax component is separated from the resin component, thereby making the preparation of toner difficult. With the increase in an amount ratio of the ethyl polysaccharide, the viscosity of the wax solution becomes high. As a result of intensive investigation, it is preferable that ethyl polysaccharide and the wax be mixed at a ratio by weight of 97:3 to 5:95. In practice, however, the fixing of toner image is not always carried out in an air-conditioned place such as an office. In view of various environmental conditions, for example, high temperature low temperature, high humidity, and low humidity, it is more preferable that the ethyl polysaccharide and the wax be mixed at a ratio by weight of (95:5) to (20:80), and further preferably (90:10) to (30:70). Furthermore, in consideration of the degree of freedom in the image fixing conditions, the most preferable mixing ratio of the ethyl polysaccharide to the wax is in the range of (80:20) to (40:60).

In the toner of the present invention, the binder may further comprise conventional resins in addition to the ethyl polysaccharide. In any case, it is preferable that the ethyl polysaccharide be contained in the binder in an amount of 10 wt. % or more, more preferably 15 wt. % or more, 20 wt. % or more, 30 wt. % or more, 40 wt. % or more, and further preferably 50 wt. % or more, of the total weight of the binder.

When the amount of ethyl polysaccharide is less than 10 wt. % of the total weight of the binder, the melting point of the obtained toner cannot be sufficiently decreased. The result is that defective image fixing cannot be inhibited.

It is preferable that the melting point of the employed wax be lower than that of the ethyl polysaccharide. In this case, the wax can be melted at a temperature lower than the melting point of the ethyl polysaccharide, and the ethyl polysaccharide can be dissolved in the wax. As a result, the melting point of the obtained toner can be decreased. In the present invention, it is preferable that the melting point of the wax be 50 to 130° C., more preferably 50 to 110° C., further preferably 50 to 100° C., and most further preferably 50 to 90° C.

In addition, it is preferable that the wax have a melt viscosity of 1 to 1,000,000 centipoise (cP) at 150° C. The lower the melt viscosity of the wax, the better. However, there is no information about any wax with a melt viscosity of less than 1 centipoise. When the ethyl polysaccharide is dissolved in a wax to prepare a wax solution, the wax solution of ethyl polysaccharide shows high viscosity if the wax itself has a high melt viscosity. When the melt viscosity of the wax exceeds 1,000,000 centipoise, defective image fixing easily occurs because of excessively high viscosity of the wax solution of ethyl polysaccharide. Further, in fact, the image fixing is not always carried out under air-conditioned circumstances. With various image fixing environments being taken into consideration such as high and low temperatures and high and low humidities, it is preferable that the wax have a melt viscosity of 1 to 1,000,000 centipoise (cP), more preferably 1 to 100,000 cP, further preferably 1 to 10,000 cP, and further more preferably 1 to 1,000 cP at 150° C. In view of the degree of freedom in the image fixing conditions, the wax with a melt viscosity of 1 to 100 cP is most preferable.

With respect to the molecular weight of the ethyl polysaccharide, for obtaining satisfactory image fixing performance and grindability, it is preferable that the ethyl polysaccharide have an average molecular weight of 500 to 1,000,000, and more preferably 1,000 to 100,000 in terms of a polystyrene-reduced value by gel permeation chromatography (GPC).

In general, when an ethyl polysaccharide with a lower molecular weight is dissolved in a wax, the resulting wax solution shows a lower viscosity. A wax solution of an ethyl polysaccharide with a higher molecular weight exhibits a higher viscosity. Therefore, when an ethyl polysaccharide with a lower molecular weight is used, the amount of wax required to prepare a wax solution can be reduced. However, when the molecular weight of the ethyl polysaccharide is excessively low, the flexibility of the resin component including ethyl polysaccharide is insufficient. As a result, the resultant toner composition tends to be easily broken, and therefore, the toner composition is excessively pulverized in the preparation of toner particles.

On the other hand, the molecular weight of the ethyl polysaccharide increases, the viscosity of a wax solution obtained by dissolving the ethyl polysaccharide in a wax increases. As a result, it is necessary to increase the amount of wax, Further, when the molecular weight of the ethyl polysaccharide is excessively high, the flexibility of the obtained toner composition becomes too high, with the result that the grindability of toner composition is lowered.

In measurement of the molecular weight of the ethyl polysaccharide, other methods than the GPC are usable for determining the molecular weights For instance, based on a principle that the molecular weight is in proportion to the viscosity, an ethyl polysaccharide is dissolved in a solvent and the molecular weight of the ethyl polysaccharide may be expressed by the viscosity of the resulting solution of ethyl polysaccharide. The molecular weight may be represented by the equivalent amount by use of a chemical agent. In principle, the value obtained by the GPC method is the same as that measured by other methods mentioned above.

Further, when the ethyl polysaccharide has an average ethoxyl group content of 1 to 3, the advantageous properties of ethyl polysaccharide can be obtained. When the ethoxyl group content is too low, the solubility of ethyl polysaccharide in waxes is lowered. The number of alcohol hydroxyl groups is three in a D-glucose structural unit. In consideration of the above, it is more preferable that the average ethoxyl group content of ethyl polysaccharide be 1.5 to 3, and further preferably 2 to 3.

It is preferable that the employed wax exhibit a penetration of 0 to 40 at 25° C. In general, a wax with a high penetration exhibits high adhesion properties, so that such a wax is not suitable for the toner composition in consideration of the spent-toner phenomenon, toner filming phenomenon, and the like. Furthermore, with the operation under the circumstances of high temperature taken into consideration, it is more preferable that the penetration of the employed wax be 0 to 20 at 25° C.

Examples of the wax for use in the present invention include paraffin wax, oxidized paraffin wax, microcrystalline wax, oxidized microcrystalline wax, rice wax, candelilla wax, montan acid, montan wax, carnauba wax, a wax derived from esparto, castor wax, Japan wax, beedswax, jojoba wax, sterol wax, ketone wax, fatty acid wax, fatty alcohol wax, fatty ester wax, fatty amide wax, and olefin wax.

Of those waxes, paraffin wax, oxidized paraffin wax, microcrystalline wax, oxidized microcrystalline wax, rice wax, candelilla wax, fatty acid wax, fatty alcohol wax, fatty ester wax, fatty amide wax, and olefin wax are preferably employed in the present invention.

The solubility of the ethyl polysaccharide in any of the above-mentioned waxes is so high that the ethyl polysaccharide can be speedily dissolved in the wax in the preparation of a toner. It is considered that the compatibility of ethoxyl group in the ethyl polysaccharide with the waxes are very high because of remarkably low polarities of those waxes.

As mentioned above, the inventor of the present invention has found an image fixing system capable of being effected at a temperature that is lower than the melting point of a resin used in the toner composition. To be more specific, by using the combination of a resin with a melting point higher than an image fixing lower limit temperature and a wax with a melting point lower than the image fixing lower limit temperature, the wax can work as a solvent or plasticizer at temperatures above the melting point of the wax, and the resin is dissolved on a molecular level in the wax. The result is that the resin is softened or dissolved in the wax to such an extent that the toner can be fixed. In fact, the toner of the present invention is fixable at temperatures adjacent to the melting point of the employed wax, and by far lower than the melting point of the employed resin. When the ethyl polysaccharide of which melting point is considerably high is used as the binder resin for the preparation of a toner composition, toner fixing can be achieved at low image fixing temperatures. This can make a contribution to energy-saving.

The melting point of the resin is measured by a flow tester method in the present invention. The melting point of the wax is a temperature where the crystals are made practically amorphous to assume a transparent state. Namely, the melting point of the wax defined in the present invention is different from the glass transition temperature (Tg) by DSC method, or a top peak in an endothermic curve.

The use of a wax in a toner composition is conventionally known. However, in such a conventional toner, the wax is dispersed in a resin in the preparation of a toner composition in order to prevent the obtained toner from adhering to the surface of an image fixing roller. The wax dispersed in the resin oozes out in the image fixing step to improve the release properties of the obtained toner from the image fixing roller. The resins conventionally used for the toner composition have no solubility in the wax, so that those resins themselves cannot be dissolved or softened therein. In contrast to this, according to the present invention, the ethyl polysaccharide is dissolved or softened in a wax of a liquid state at temperatures higher than the melting point of the wax.

In general, polysaccharides are not melted by the application of heat, and are completely insoluble in water, waxes, or organic solvents. This is because hydrogen bonding properties resulting from the presence of hydroxyl groups in a molecule of the polysaccharides are remarkably strong, and crystallizability is extremely high.

In contrast to the above, the toner composition for use in the present invention employs an ethyl polysaccharide. In the ethyl polysaccharide, ethoxyl group is substituted for hydroxyl group in a molecule thereof, so that the above-mentioned strong hydrogen bonding properties caused by the hydroxyl group as in polysaccharides are lost, with the result that the crystallizability of ethyl polysaccharide is decreased. An ethyl polysaccharide is thus synthesized as an absolutely different type of resin from a polysaccharide.

Japanese Laid-Open Patent Application 62-94853 discloses a toner composition comprising an ethyl polysaccharide. However, in this case, the ethyl polysaccharide in a small amount is added to other resins to improve the cohesion of a binder resin as a whole. In contrast to this, an ethyl polysaccharide is used as the main binder resin in the present invention. Further, on the contrary, the cohesion of the binder resin for use in the present invention tends to decrease because the ethyl polysaccharide is dissolved in a wax to decrease the viscosity. According to Japanese Laid-Open Patent Application 62-94853, a mixture of the resins is fixed in the image fixing step, and the image fixing temperature is as high as the conventional image fixing temperatures. In the present invention, the fixing properties of toner are determined by the fact that the ethyl polysaccharide serving as the main binder resin is dissolved in a wax. Namely, the image fixing temperature can be remarkably decreased.

Basically, no resin is dissolved in a wax. As a matter of course, a polysaccharide, that is, a precursor of the ethyl polysaccharide for use in the present invention, is not soluble in a wax. The polysaccharides have D-glucose units linked together by a linkage of 1,2-, 1,3-, 1,4-, or 1,6-glycosidic bond with an $\alpha$ configuration, or by a linkage of 1,2-, 1,4- or 1,6-glycosidic bond with a $\beta$ configuration. In the ethyl polysaccharides, three alcohol hydroxyl groups in each of the D-glucose units are partially or entirely replaced by ethoxyl group.

The reason why the polysaccharides are not melted when heated and why the polysaccharides are not soluble in water, waxes, and a variety of organic solvents is that the hydrogen bonding properties of alcohol hydroxyl groups in the D-glucose unit are too strong. Therefore, the intermolecular bond strength is remarkably high and the crystallizability is high, with the result that the molecular chain is rigid. The polysaccharides show a strong polarity due to strong polarity of hydroxyl groups in the molecule thereof, while the polarity of a wax is relatively low. A great difference in polarity is a cause of insolubility of polysaccharide in waxes.

In contrast to this, ethyl polysaccharide can be dissolved in waxes. In the ethyl polysaccharide, three alcohol hydroxyl groups in a D-glucose unit are partially or entirely replaced by ethoxyl groups. The number of locations for hydrogen bonding is decreased, and the crystallizability is also decreased. Further, since the polarity of ethoxyl group is low, the affinity of ethyl polysaccharide for the wax with a low polarity is increased, and therefore, ethyl polysaccharide is easily dissolved in the wax. Waxes for general use have a straight-chain paraffin, branched olefin, fatty acid, fatty ester, fatty ketone, amine, amide, alcohol, and sterol. However, each of those portions is just a linkage or group in a part of a molecule. An alkyl group moiety as the main structure in the wax is suite long, so that the polarity of the wax becomes low as a whole.

An ethyl polysaccharide for use in the present invention is produced, for example, by the following method.

An alkali polysaccharide is made from a polysaccharide. Ethyl chloride is allowed to react with the alkali polysaccharide in a pressure application vessel, and the resultant polysaccharide is washed with hot water and dried. The obtained polysaccharide consists of chains of glucose anhydride. Each unit has originally three hydroxyl groups, but the three hydroxyl groups are partially or entirely replaced by ethoxyl groups by use of ethyl chloride.

In accordance with the following reaction schemes, ethyl polysaccharides can be prepared:

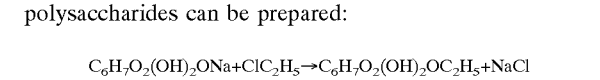

$$C_6H_7O_2(OH)_2ONa+ClC_2H_5 \rightarrow C_6H_7O_2(OH)_2OC_2H_5+NaCl$$

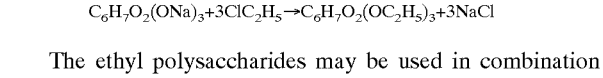

$$C_6H_7O_2(ONa)_3+3ClC_2H_5 \rightarrow C_6H_7O_2(OC_2H_5)_3+3NaCl$$

The ethyl polysaccharides may be used in combination with other resins to prepare a toner composition in the present invention. Specific examples of such resins for use in the toner include homopolymers of styrene and substituted styrenes such as polystyrene, poly-p-chlorostyrene, and polyvinyltoluene; styrene-based copolymers such as styrene p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer; and poly(methyl methacrylate), poly(butyl methacrylate), poly(vinyl chloride), poly(vinyl acetate), polyester, polyurethane, polyamide, epoxy resin, poly(vinyl butyral), polyacrylic acid resin, rosin, modified rosin, terpene resin, aliphatic or alicyclic hydrocarbon resin, aromatic petroleum resin, and chlorinated paraffin. These resins may be used alone or in combination.

A coloring agent such as carbon black or a color pigment may be kneaded and dispersed in the above-mentioned resin. A charge control agent may also be contained in the toner composition.

A toner composition thus prepared is subjected to pulverized to produce toner particles. To control the fluidity of toner particles, an additive such as silica, titanium, or strontium may be added to the toner particles.

A one-component developer for electrophotography can be prepared using the above-mentioned toner containing the mixture of ethyl polysaccharide and a wax. Further, such a toner may be mixed with a carrier to prepare a two-component developer.

With reference to a single FIGURE, a container for containing the above-mentioned one- or two-component developer and an image forming apparatus provided with the container will now be explained in detail.

A single FIGURE is a schematic cross sectional view which shows one embodiment of an image forming apparatus provided with a developer container according to the present invention. In the image forming apparatus shown in the single FIGURE, a development section 1 (developer supply means) and a developer container 2 (developer storage means) which stores therein an electrophotographic developer to be sent to the development section 1 are connected by developer transporting means 3.

The development section 1 is composed of a developer housing 4 for holding a two-component developer D therein, first and second stirring screws 5 and 6 for mixing and stirring the developer D in the developer housing 4, and a development roller 7. The development roller 7 is opposite to a latent image bearing member, that is, an electrophotographic photoconductor 8. The photoconductor 8 is driven in rotation in a direction of the arrow, with the surface of the photoconductor bearing latent electrostatic images thereon.

In the FIGURE, a connecting member 24 is connected to a developer inlet 23, and a cap 26 is fit in the connecting member 24 via a filter 25. The filter 25 may be inserted or not.

In the image forming apparatus, charging means, light exposure means, image transfer means, quenching means, cleaning means, and other conventional means are arranged, although not shown in the FIGURE, around the photoconductor 8.

In the development section 1, the developer D is stirred by the rotating action of the stirring screws 5 and 6, whereby the toner and the carrier are charged to the opposite polarities by triboelectric charging. The two-component developer D is thus supplied toward the development roller 7 that is driven in rotation in a direction of the arrow, and supported on the periphery of the development roller 7. The developer D on the development roller 7 travels along the rotating direction of the development roller 7 while the amount of the developer D is regulated by a doctor blade 9. After the amount of developer D is regulated, the developer D is transported to a gap between the development roller 7 and the photoconductor 8, where the toner component in the two-component developer D is electrostatically attracted to latent electrostatic images formed on the surface of the photoconductor 8. Thus, the toner component is transferred to the latent electrostatic images, thereby achieving development of the latent electrostatic images with a toner to form visible toner images on the photoconductor 8.

Other features of this invention will become apparent in the course of the following description of exemplary embodiments, which are given for illustration of the invention and are not intended to be limiting thereof.

EXAMPLE 1

A mixture of the following components was fused and kneaded in a three-roll mill five times, and thereafter cooled.

| | wt. % |
|---|---|
| Ethyl polysaccharide | 78 |
| Sazol wax | 16 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 1 according to the present invention was obtained.

EXAMPLE 2

A mixture of the following components was fused and kneaded in a three-roll mill five times, and thereafter cooled.

| | wt. % |
|---|---|
| Ethyl polysaccharide | 50 |
| Sazol wax | 10 |
| Magnetic material | 39 |
| Charge control agent | 1 |

The cooled mixture was pulverized to prepare toner particles. 100 parts by weight of the toner particles were mixed with one part by weight of silica serving as an external additive, whereby a toner No. 2 according to the present invention was obtained.

EXAMPLE 3

A mixture of the following components was fused and kneaded in a three-roll mill five times, and thereafter cooled.

| | wt. % |
|---|---|
| Ethyl polysaccharide | 72 |
| Carnauba wax | 22 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 3 according to the present invention was obtained.

EXAMPLE 4

A mixture of the following components was fused and kneaded in a three-roll mill five times, and thereafter cooled.

| | wt. % |
|---|---|
| Ethyl polysaccharide | 72 |
| Montan wax | 39 |

-continued

| | wt. % |
|---|---|
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 4 according to the present invention was obtained.

EXAMPLE 5

A mixture of the following components was fused and kneaded in a three-roll mill five times, and thereafter cooled.

| | wt. % |
|---|---|
| Ethyl polysaccharide | 78 |
| Paraffin wax | 16 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 5 according to the present invention was obtained.

EXAMPLE 6

A mixture of the following components was fused and kneaded in a three-roll mill five times, and thereafter cooled.

| | wt. % |
|---|---|
| Ethyl polysaccharide | 74 |
| Rice wax | 20 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 6 according to the present invention was obtained.

EXAMPLE 7

A mixture of the following components was fused and kneaded in a three-roll mill five times, and thereafter cooled.

| | wt % |
|---|---|
| Ethyl polysaccharicie | 74 |
| Oxidized paraffin | 20 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 7 according to the present invention was obtained.

EXAMPLE 8

A mixture of the following components was fused and kneaded in a three-roll mill five times, and thereafter cooled.

| | wt. % |
|---|---|
| Ethyl polysaccharide | 74 |
| Oxidized paraffin | 20 |
| Cyan pigment | 5 |
| Charge control agent | 1 |

The cooled mixture was pulverized to prepare toner particles. 100 parts by weight of the toner particles were mixed with one part by weight of silica serving as an external additive, whereby a toner No. 8 according to the present invention was obtained.

EXAMPLE 9

A mixture of the following components was fused and kneaded in a three-roll mill five times, and thereafter cooled.

| | wt. % |
|---|---|
| Ethyl polysaccharide | 72 |
| Carnauba wax | 22 |
| Yellow pigment | 5 |
| Charge control agent | 1 |

The cooled mixture was pulverized to prepare toner particles. 100 parts by weight of the toner particles were mixed with one part by weight of silica serving as an external additive, whereby a toner No. 9 according to the present invention was obtained.

EXAMPLE 10

A mixture of the following components was fused and kneaded in a three-roll mill five times, and thereafter cooled.

| | wt % |
|---|---|
| Ethyl polysaccharide | 42 |
| High-melting point polyester (mp: 155° C.) | 30 |
| Carnauba wax | 22 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 10 according to the present invention was obtained.

COMPARATIVE EXAMPLE 1

A mixture of the following components was fused and kneaded in a three-roll mill five times, and thereafter cooled.

| | wt. % |
|---|---|
| High-melting point polyester (mp: 155° C.) | 94 |
| Carbon black | 5 |
| Charge control agent | 1 |

The cooled mixture was pulverized to prepare toner particles. 100 parts by weight of the toner particles were mixed with one part by weight of silica serving as an external additive, whereby a comparative toner No. 1 was obtained.

COMPARATIVE EXAMPLE 2

A mixture of the following components was fused and kneaded in a three-roll mill five times, and thereafter cooled.

| | wt. % |
|---|---|
| Low-melting point polyester (mp: 94° C.) | 94 |
| Carbon black | 5 |
| Charge control agent | 1 |

The cooled mixture was pulverized to prepare toner particles. 100 parts by weight of the toner particles were mixed with one part by weight of silica serving as an external additive, whereby a comparative toner No. 2 was obtained.

COMPARATIVE EXAMPLE 3

A mixture of the following components was fused and kneaded in a three-roll mill five times, and thereafter cooled.

| | wt. % |
|---|---|
| Ethyl polysaccharide | 94 |
| Carbon black | 5 |
| Charge control agent | 1 |

The cooled mixture was pulverized to prepare toner particles. 100 parts by weight of the toner particles were mixed with one part by weight of silica serving as an external additive, whereby a comparative toner No. 3 was obtained.

COMPARATIVE EXAMPLE 4

A mixture of the following components was fused and kneaded in a three-roll mill five times, and thereafter cooled.

| | wt. % |
|---|---|
| High-melting point polyester (mp: 155° C.) | 78 |
| Sazol wax | 16 |
| Carbon black | 5 |
| Charge control agent | 1 |

In this case, the resin component was separated from the wax component, and therefore, it was impossible to prepare a toner.

A: Measurement of Image Fixing Temperature

Each of the obtained toners No. 1 to No. 10 according to the present invention and comparative toners No. 1 to No. 3 was set in a developer unit of an electrophotographic copying machine. With the temperature of an image fixing unit being variously changed, the permissible image fixing temperature was obtained. In any case, a releasing oil was applied to the surface of an image fixing roller. The results are shown in TABLE 1.

TABLE 1

| | Surface Temperature of Image Fixing Unit (° C.) | | | | | | |
|---|---|---|---|---|---|---|---|
| | 70 | 80 | 90 | 100 | 120 | 140 | 160 |
| Ex. 1 | | X | X | ○ | ○ | | |
| Ex. 2 | | X | X | ○ | ○ | | |
| Ex. 3 | | X | ○ | ○ | | | |
| Ex. 4 | X | ○ | ○ | | | | |
| Ex. 5 | X | ○ | ○ | | | | |
| Ex. 6 | X | ○ | ○ | | | | |
| Ex. 7 | | X | ○ | ○ | | | |
| Ex. 8 | | X | ○ | ○ | | | |
| Ex. 9 | | X | ○ | ○ | | | |
| Ex. 10 | | X | ○ | ○ | | | |
| Comp. Ex. 1 | | | | | X | X | ○ |
| Comp. Ex. 2 | | | X | ○ | ○ | | |
| Comp. Ex. 3 | | | | | X | X | ○ |

In the above TABLE 1, "○" means that fixing of toner images was satisfactorily carried out, and "X" means that defective fixing occurred.

As can be seen from the results shown in TABLE 1, when the high-melting point polyester resin is used alone as the binder resin in Comparative Example 1, the lower limit image fixing temperature is as high as 160° C. As shown in Comparative Example 3, when ethyl polysaccharide is used alone as the binder, the lower limit image fixing temperature is also as high as 160° C.

In contrast to this, when an ethyl polysaccharide is used in combination with a wax, the lower limit image fixing temperature ranges from 80 to 120° C.

B: Preservation Test

Each of the toners was subjected to a preservation test by allowing each toner to stand at 40° C. for 2 weeks, The preservation stability of toner was evaluated in terms of the following two points:

(1) Charge Quantity

The charge quantity of a one-component developer was measured on a development sleeve before and after storage.

(2) Toner Deposition on Background of OPC

The degree of toner deposition on the background of an electrophotographic photoconductor was examined in such a manner that a transparent adhesive tape was put on the surface of the photoconductor after copying operation, and separated therefrom, and then attached to a sheet of fresh white paper. The optical density ($ID^1$) of the tape-attached portion was measured.

Another transparent adhesive tape was attached to the surface of a sheet of fresh white paper, and the optical density ($ID^2$) of the tape-attached portion was also measured. The difference ($\Delta ID$) determined by the following formula was obtained.

$$\Delta ID - ID^1 - ID^2$$

The smaller the value of $\Delta ID$, the less the toner deposition on the background of the photoconductor.

The results are shown in TABLE 2.

TABLE 2

| | Condition | Charge Quantity (μC/g) | | Toner Deposition on Background of OPC | |
|---|---|---|---|---|---|
| | after Storage | Before storage | After storage | Before storage | After storage |
| Ex. 1 | ○ | −19 | −19 | 0.01 | 0.01 |
| Ex. 2 | ○ | −21 | −20 | 0.01 | 0.02 |
| Ex. 3 | ○ | −22 | −20 | 0.01 | 0.01 |
| Ex. 4 | ○ | −21 | −20 | 0.01 | 0.01 |
| Ex. 5 | ○ | −22 | −21 | 0.01 | 0.01 |
| Ex. 6 | ○ | −20 | −22 | 0.01 | 0.01 |
| Ex. 7 | ○ | −22 | −22 | 0.01 | 0.01 |
| Ex, 8 | ○ | −20 | −22 | 0.01 | 0.02 |
| Ex. 9 | ○ | −19 | −20 | 0.01 | 0.02 |
| Ex. 10 | ○ | −20 | −18 | 0.02 | 0.03 |
| Comp. Ex. 1 | ○ | −23 | −17 | 0.01 | 0.04 |
| Comp. Ex. 2 | Completely solidified | −20 | not measured | 0.01 | not measured |
| Comp. Ex. 3 | ○ | −20 | −20 | 0.02 | 0.02 |

In TABLE 2, "○" means that no change was observed after storage.

As can be seen from the results shown in TABLE 2, the preservation stability of the toners according to the present invention is excellent. In Comparative Example 1 where a high-melting point polyester is used alone as the binder, there are some changes in properties and the preservation stability is slightly poor, but acceptable for practical use.

However, the comparative toner No. 2 comprising a low-melting point polyester resin as the binder caused complete caking during the storage. Therefore, the measurement was not carried out after the storage.

C: Running Test

Each of the toners was subjected to a running test by making 2,000 copies. The change in charge quantity and the change in degree of toner deposition on background of the photoconductor were checked before and after the running test.

The charge quantity and the toner deposition on the background of the photoconductor were measured in the same manner as mentioned above in the preservation test.

The results are shown in TABLE 3.

TABLE 3

| | Charge Quantity (μC/g) | | Toner Deposition on Background of OPC | |
|---|---|---|---|---|
| | Before running test | After running test | Before running test | After running test |
| Ex. 1 | −20 | −21 | 0.01 | 0.01 |
| Ex. 2 | −21 | −21 | 0.01 | 0.01 |
| Ex. 3 | −21 | −22 | 0.01 | 0.01 |
| Ex. 4 | −21 | −20 | 0.01 | 0.01 |
| Ex. 5 | −20 | −21 | 0.01 | 0.01 |
| Ex. 6 | −21 | −20 | 0.01 | 0.01 |
| Ex. 7 | −23 | −22 | 0.01 | 0.01 |
| Ex. 8 | −21 | −21 | 0.01 | 0.01 |
| Ex. 9 | −21 | −22 | 0.01 | 0.01 |
| Ex. 10 | −21 | −18 | 0.02 | 0.04 |
| Comp. Ex. 1 | −23 | −15 | 0.01 | 0.06 |
| Comp. Ex. 2 | −20 | −10 | 0.01 | 0.12 |
| Comp. Ex. 3 | −22 | −21 | 0.01 | 0.01 |

As can be seen from the results shown in TABLE 3, with respect to the toners according to the present invention, the change in charge quantity is trifling, and the degree of toner deposition on the background of the photoconductor does not change before and after the running test.

As for the comparative toner No. 1, the charge quantity tends to lower and the toner deposition on the background tends to increase after the running test. In the case of the comparative toner No. 2, the charge quantity drastically decreases and the degree of toner deposition on the background is not acceptable for practical use.

D: Observation of Developer Unit after Image Formation

Each toner was used in combination with a carrier to prepare a two-component developer. Using each two-component developer, 2,000 copies were made to examine whether toner particles adhered to the surface of the carrier or not (spent toner phenomenon). Furthermore, after 2,000 copies were made using a one-component developer, it was examined whether the surface of a development roller was coated with a film of toner (toner filming phenomenon) and whether the toner particles were deposited on a doctor blade in the developer unit.

The results are shown in TABLE 4.

TABLE 4

| | Spent Toner Phenomenon | Toner Filming | Toner Deposition on Developer Blade |
|---|---|---|---|
| Ex. 1 | 1 | 1 | 1 |
| Ex. 2 | 1 | 1 | |
| Ex. 3 | 1 | 1 | 1 |
| Ex. 4 | 1 | 1 | 1 |
| Ex. 5 | 1 | 1 | 1 |
| Ex. 6 | 1 | 1 | 1 |
| Ex. 7 | 1 | 1 | 1 |
| Ex. 8 | 1 | 1 | 1 |
| Ex. 9 | 1 | 1 | 1 |
| Ex. 10 | 1 | 2 | 1 |
| Comp. Ex. 1 | 2 | 2 | 2 |
| Comp. Ex. 2 | 3 | 3 | 3 |
| Comp. Ex. 3 | 1 | 1 | 1 |

In TABLE 4, the evaluation level 1 means that no problem occurred; the evaluation level 2, the phenomenon slightly occurred, but acceptable for practical use; and the evaluation level 3, the phenomenon was so serious that image quality was adversely affected.

As for the comparative toner No. 1, the toner filming phenomenon, the spent toner phenomenon, and the deposition of toner on the doctor blade were slightly observed. In the case of the comparative toner No. 2, the toner filming phenomenon, the spent toner phenomenon, and the deposition of toner on the doctor blade were very noticeable. Because of those problems, defective images were produced. For example, the image density was uneven, the toner deposition appeared on the background of a sheet of image-receiving paper, and non-printed white stripes were observed in image portions.

E: Preservability of Image-bearing Material

After completion of fixing of toner images on sheets, the preservability of the toner-image-bearing sheets was examined by continuously performing image formation on one side of a sheet, and on both sides of a sheet.

The results are shown in TABLE 5.

TABLE 5

| | Printing on One Side | Printing on Both Sides |
|---|---|---|
| Ex. 1 | 1 | 1 |
| Ex. 2 | 1 | 1 |

TABLE 5-continued

| | Printing on One Side | Printing on Both Sides |
|---|---|---|
| Ex. 3 | 1 | 1 |
| Ex. 4 | 1 | 1 |
| Ex. 5 | 1 | 1 |
| Ex. 6 | 1 | 1 |
| Ex. 7 | 1 | 1 |
| Ex. 8 | 1 | 1 |
| Ex. 9 | 1 | 1 |
| Ex. 10 | 1 | 1 |
| Comp. Ex. 1 | 1 | 1 |
| Comp. Ex. 2 | 2 | 3 |
| Comp. Ex. 3 | 1 | 1 |

In TABLE 5, the evaluation level 1 means that no problem occurred; the evaluation level 2, the rear surface of a sheet was slightly stained with toner because of transfer of toner from the underlying sheet; and the evaluation level 3, the toner deposited on the front side of one sheet the toner deposited on the rear side of the overlying sheet produced a blocking problem.

The sheets were stained with toner and the blocking phenomenon occurred when the comparative toner No. 2 was employed.

F: Efficiency of Pulverizing Step

The efficiency of the pulverizing step was evaluated in the course of preparation of toner particles. To be more specific, the period of time required to obtain a fixed amount of toner particles with a predetermined particle size was measured, and the inside of a pulverizer was visually observed.

The results are shown in TABLE 6.

TABLE 6

| | Time Required for Pulverizing (hr.) | Toner Deposition on Inner Wall of Pulverizer |
|---|---|---|
| Ex. 1 | 0.25 | None |
| Ex. 2 | 0.25 | None |
| Ex. 3 | 0.25 | None |
| Ex. 4 | 0.25 | None |
| Ex. 5 | 0.25 | None |
| Ex. 6 | 0.25 | None |
| Ex. 7 | 0.25 | None |
| Ex. 8 | 0.25 | None |
| Ex. 9 | 0.25 | None |
| Ex. 10 | 0.50 | None |
| Comp. Ex. 1 | 0.75 | None |
| Comp. Ex. 2 | 2.00 | Toner particles were accumulated on the detector of the pulverizer. |
| Comp. Ex. 3 | 0.25 | None |

In the case of the preparation of the comparative toner No. 2, it took much time to pulverize the toner composition. In addition, toner particles were scattered and considerably deposited on the inner wall of the pulverize. In this case, there is a risk that the pulverizing conditions vary during the pulverizing step.

As previously explained, the toner of the present invention is fixable at a temperature lower than the melting point of the ethyl polysaccharide, thereby realizing energy saving. Even though the toner is fused at a lower temperature, the preservation stability of toner is improved because the melting point of ethyl polysaccharide itself is high. Further, the change in properties of toner can be minimized because ethyl polysaccharide for use in the toner is a rigid resin. More specifically, the external additive can be prevented from being pushed into the toner particle, and being stained with a low-molecular-weight resin. Furthermore, the spent toner phenomenon, toner filming phenomenon and the like can be effectively inhibited because the ethyl polysaccharide is rigid and has no adhesive properties. In addition, the obtained toner-image-bearing material does not cause any blocking problem. The toner composition of the present invention is appropriately rigid due to the ethly polysaccharide, so that the toner particles can be efficiently produced by pulverizing.

Japanese Patent Application No. 2000-026723 filed Feb. 3, 2000 and Japanese Patent Application No. 2000-030313 filed Feb. 8, 2000 are hereby incorporated by reference.

What is claimed is:

1. A toner for electrophotography comprising:

a coloring agent and a binder comprising a wax and an ethyl polysaccharide.

2. The toner as claimed in claim 1, wherein said ethyl polysaccharide comprises D-glucose units linked together by a linkage of 1,2-, 1,3-, 1,4-, or 1,6-glycosidic bond with an α configuration, or by a linkage of 1,2-, 1,3-, 1,4- or 1,6-glycosidic bond with a β configuration, with at least one alcohol hydroxyl group in each of said D-glucose units being ethyl-etherified.

3. The toner as claimed in claim 1, wherein said toner is fixable at a temperature lower than a melting point of said ethyl polysaccharide and higher than or equal to a melting point of said wax.

4. The toner as claimed in claim 1, wherein said ethyl polysaccharide is contained in said binder in an amount of 10 wt. % or more of the total weight of said binder.

5. The toner as claimed in claim 1, wherein said ethyl polysaccharide and said wax are mixed at a ratio by weight of 97:3 to 5:95.

6. The toner as claimed in claim 1, wherein said wax has a melting point that is lower than a melting point of said ethyl polysaccharide.

7. The toner as claimed in claim 1, wherein said wax has a melt viscosity of 1 to 1,000,000 centipoise (cP) at 150° C.

8. The toner as claimed in claim 1, wherein said ethyl polysaccharide has an average molecular weight of 500 to 1,000,000 in terms of a polystyrene-reduced value by gel permeation chromatography (GPC).

9. The toner as claimed in claim 1, wherein said ethyl polysaccharide has an average ethoxyl group content of one to three.

10. The toner as claimed in claim 1, wherein said wax exhibits a penetration of 0 to 40 at 25° C.

11. The toner as claimed in claim 10, wherein said wax is selected from the group consisting of paraffin wax, oxidized paraffin wax, microcrystalline wax, oxidized mictocrystalline wax, rice wax, candelilla wax, fatty acid wax, fatty alcohol wax, fatty ester wax, fatty amide wax, and olefin wax.

12. The toner as claimed in claim 1, further comprising a charge control agent.

13. A one-component developer for electrophotography comprising a toner which comprises a coloring agent and a binder comprising a wax and an ethyl polysaccharide.

14. The one-component developer as claimed in claim 13, wherein said ethyl polysaccharide comprises D-glucose units linked together by a linkage of 1,2-, 1,3-, 1,4-, or 1,6-glycosidic bond with an α configuration, or by a linkage of 1,2-, 1,3-, 1,4- or 1,6-glycosidic bond with a β configuration, with at least one alcohol hydroxyl group in each of said D-glucose units being ethyl-etherified.

15. A two-component developer for electrophotography comprising a carrier and a toner which comprises a coloring agent and a binder comprising a wax and an ethyl polysaccharide.

16. The two-component developer as claimed in claim 15, wherein said ethyl polysaccharide comprises D-glucose units linked together by a linkage of 1,2-, 1,3-, 1,4-, or 1,6-glycosidic bond with an α configuration, or by a linkage of 1,2-, 1,3-, 1,4- or 1,6-glycosidic bond with a β configuration, with at least one alcohol hydroxyl group in each of said D-glucose units being ethyl-etherified.

17. A developer container containing a one-component developer for electrophotography comprising a toner which comprises a coloring agent and a binder comprising a wax and an ethyl polysaccharide.

18. A developer container containing a two-component developer for electrophotography comprising a carrier and a toner which comprises a coloring agent and a binder comprising a wax and an ethyl polysaccharide.

19. An image forming apparatus comprising a developer unit which comprises developer storage means for storing a one-component developer therein and developer supply means for supplying said developer to a latent-image bearing surface, said one-component developer comprising a toner comprising a coloring agent and a binder which comprises a wax and an ethyl polysaccharide.

20. An image forming apparatus comprising a developer unit which comprises a developer storage means for storing a two-component developer therein and a developer supply means for supplying said developer to a latent-image bearing surface, said two-component developer comprising a carrier and a toner which comprises a coloring agent and a binder comprising a wax and an ethyl polysaccharide.

21. A process unit comprising a developer unit which comprises developer storage means for storing a one-component developer therein and developer supply means for supplying said developer to a latent-image bearing surface, said one-component developer comprising a toner which comprises a coloring agent and a binder comprising a wax and an ethyl polysaccharide.

22. A process unit comprising a developer unit which comprises developer storage means for storing a two-component developer therein and developer supply means for supplying said developer to a latent-image bearing surface, said two-component developer comprising a carrier and a toner which comprises a coloring agent and a binder comprising a wax and an ethyl polysaccharide.

23. The toner as claimed in claim 1, wherein said ethyl polysaccharide has an average ethoxyl group content of 1.5 to 3.

24. The one-component developer as claimed in claim 13, wherein said ethyl polysaccharide has an average ethoxyl group content of 1.5 to 3.

25. The one-component developer as claimed in claim 15, wherein said ethyl polysaccharide has an ethoxyl group content of 1.5 to 3.

26. The developer as claimed in claim 17, wherein said ethyl polysaccharide has an ethoxyl group content of 1.5 to 3.

27. The developer as claimed in claim 18, wherein said ethyl polysaccharide has an ethoxyl group content of 1.5 to 3.

28. The image forming apparatus as claimed in claim 19, wherein said ethyl polysaccharide has an ethoxyl group content of 1.5 to 3.

29. The image forming apparatus as claimed in claim 20, wherein said ethyl polysaccharide has an average ethoxyl group content of 1.5 to 3.

30. The process unit as claimed in claim 21, wherein said ethyl polysaccharide has an average ethoxyl group of 1.5 to 3.

31. The process unit as claimed in claim 22, wherein said ethyl polysaccharide has an average ethoxyl group of 1.5 to 3.

* * * * *

UNITED STATES PATENT AND TRADEMARK OFFICE

CERTIFICATE OF CORRECTION

PATENT NO. : 6,413,690 B2
DATED : July 2, 2002
INVENTOR(S) : Kunihiko Tomita

It is certified that error appears in the above-identified patent and that said Letters Patent is hereby corrected as shown below:

Column 4,
Line 57, delete "of wax," and insert -- of wax. --;
Line 63, delete "weights For" and insert -- weight. For--.

Column 5,
Line 27, delete "beedswax" and insert -- beeswax --.

Column 6,
Line 58, after "1,2-," insert -- 1,3-, --.

Column 7,
Line 19, delete "suite" and insert -- quite --;
Line 45, delete "styrene p-chlorostyrene" and insert -- styrene-p-chlorostyrene --.

Column 8,
Line 1, after "to" insert -- be --.

Column 10,
Line 58, delete "polysaccharicie" and insert -- polysaccharide --.

Column 13,
Line 64, should read -- $\Delta ID^1=ID^2$ --.

Column 15,
Line 25, Ex. 2, insert -- 1 -- in the third column.

Column 16,
Line 58, delete "pulverize" and insert -- pulverizer --.

UNITED STATES PATENT AND TRADEMARK OFFICE

CERTIFICATE OF CORRECTION

PATENT NO. : 6,413,690 B2
DATED : July 2, 2002
INVENTOR(S) : Kunihiko Tomita

It is certified that error appears in the above-identified patent and that said Letters Patent is hereby corrected as shown below:

Column 17,
Line 10, delete "ethly" and insert -- ethyl --.

Column 18,
Line 46, delete "one" and insert -- two --;
Line 61, after "group" insert -- content --;
Line 64, after "group" insert -- content --.

Signed and Sealed this

Fourth Day of March, 2003

JAMES E. ROGAN
*Director of the United States Patent and Trademark Office*